US006103441A

United States Patent [19]

Tomita et al.

[11] Patent Number: 6,103,441

[45] Date of Patent: Aug. 15, 2000

[54] COLOR TONER FOR ELECTROPHOTOGRAPHY

[75] Inventors: Masami Tomita; Hiroyuki Fushimi; Yohichiroh Watanabe; Keiko Shiraishi, all of Shizuoka, Japan

[73] Assignee: Ricoh Company, Ltd., Tokyo, Japan

[21] Appl. No.: 09/432,569

[22] Filed: Nov. 12, 1999

[30] Foreign Application Priority Data

Nov. 12, 1998 [JP] Japan ..... 10-322190
Jan. 18, 1999 [JP] Japan ..... 11-008896

[51] Int. Cl.[7] ..... G03G 9/097

[52] U.S. Cl. ..... 430/110; 430/111

[58] Field of Search ..... 430/110, 111

[56] References Cited

U.S. PATENT DOCUMENTS

| | | | |
|---|---|---|---|
| 4,758,489 | 7/1988 | Tomita et al. | 430/106 |
| 4,762,763 | 8/1988 | Nomura et al. | 430/110 |
| 4,888,263 | 12/1989 | Tomita et al. | 430/106 |
| 4,908,290 | 3/1990 | Watanabe et al. | 430/109 |
| 4,933,250 | 6/1990 | Nakayama et al. | 430/106 |
| 4,956,258 | 9/1990 | Watanabe et al. | 430/109 |
| 4,980,258 | 12/1990 | Aoki et al. | 430/110 |
| 5,061,588 | 10/1991 | Fushimi et al. | 430/109 |
| 5,164,774 | 11/1992 | Tomita et al. | 430/106 |
| 5,225,303 | 7/1993 | Tomita et al. | 430/110 |
| 5,244,765 | 9/1993 | Katoh et al. | 430/110 |
| 5,288,577 | 2/1994 | Yamaguchi et al. | 430/111 |
| 5,368,972 | 11/1994 | Yamashita et al. | 430/137 |
| 5,429,901 | 7/1995 | Muto et al. | 430/110 |
| 5,721,083 | 2/1998 | Masuda et al. | 430/106 |
| 5,840,456 | 11/1998 | Tomita et al. | 430/106 |
| 5,851,716 | 12/1998 | Kuramoto et al. | 430/110 |
| 6,001,527 | 12/1999 | Ishihara et al. | 430/110 |
| 6,004,711 | 12/1999 | Bourne et al. | 430/111 |
| 6,004,715 | 12/1999 | Suzuki et al. | 430/111 |
| 6,025,107 | 2/2000 | Sekiguchi et al. | 430/110 |

*Primary Examiner*—Roland Martin
*Attorney, Agent, or Firm*—Oblon, Spivak, McClelland, Maier & Neustadt, P.C.

[57] ABSTRACT

A color toner for electrophotography is made of matrix toner particles, each matrix toner particle containing a binder resin, a coloring agent, and a charge control agent, and an externally added additive which includes (a) hydrophobically treated silica particles having a primary particle size of 0.01 to 0.03 $\mu$m, (b) hydrophobically treated titanium oxide particles having a primary particle size of 0.01 to 0.03 $\mu$m and a specific surface area of 60 to 140 $m^2/g$, and (c) hydrophobically treated silica particles having a specific surface area of 20 to 50 $m^2/g$ and a bulk density of 100 to 250 g/l.

5 Claims, 1 Drawing Sheet

FIGURE
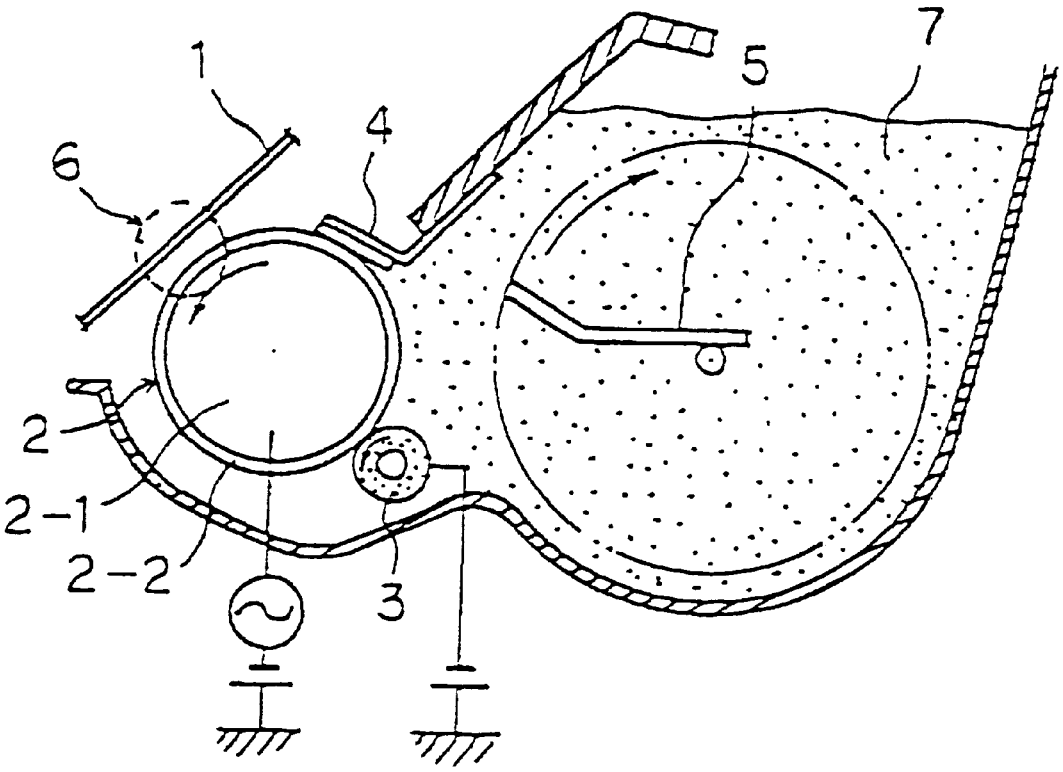

COLOR TONER FOR ELECTROPHOTOGRAPHY

BACKGROUND OF THE INVENTION

1. Field of the Invention

The present invention relates to a color toner capable of exhibiting excellent development performance for use in the electrophotographic field.

2. Discussion of Background

Recently, in the field of hard copies made by the electrophotographic process, black-and-white hard copies are now rapidly being replaced by full-color hard copies, and the market for full-color hard copies is now expanding.

In color image formation by full-color electrophotography, all colors are reproduced by using the three primary colors, that is, yellow, magenta and cyan, or four colors with the addition of black to the three primary colors.

The color image formation is generally conducted as follows. The light reflected by an original document is projected onto a photoconductive layer of a photoconductor through a color separation optical transmission filter which is in the relationship of complementary colors with the toner colors, whereby a latent electrostatic image is formed on the photoconductive layer. The latent electrostatic image thus formed is developed with a color toner, and a toner image is transferred to a toner-image-bearing member. Such a development and image-transfer process is repeated by use of other color toners to form a full-color image in such a manner that a plurality of color toners is superimposed on the identical toner-image-bearing member, with the adjustment of the registration. The thus obtained full-color images are then fixed on the toner-image-bearing member by only one time image-fixing operation.

The development system is divided into two systems. One is a two-component development system using a two-component developer comprising a toner and a carrier. The other is a mono-component development system without using a carrier, in which system a toner thin layer is formed on the surface of a development roller, and a latent electrostatic image is directly developed into a visible toner image with the toner.

In the two-component development system, a toner component and a carrier component are stirred together in a development unit so as to impart an appropriate charge quantity to the toner component.

With respect to a color toner, a binder resin with a low softening point is used for the color toner. This is because the binder resin for use in the color toner is required to completely melt at the image-fixing operation so that the fixed toner image may become a uniform thin layer and the fixed toner image may show excellent color reproduction and proper gloss. Further, in order to improve the replenishing performance of toner to the development unit and the transferring performance of toner, it is effective that an additive for improving the fluidity of toner (for example, finely-divided rigid particles) be externally added to the surface of the toner particles. However, through the vigorous stirring of the toner with the carrier in the development unit, the fluidity imparting agent externally deposited to the surface of the toner particles is easily embedded in the toner particles, especially in the color toner particles comprising a soft binder resin with a low softening point. The result is that the fluidity decreases as a matter of course, and the development performance, the transferring performance, and the replenishing performance tend to deteriorate.

On the other hand, the mono-component development system is considered to be advantageous because the carrier-free system can achieve a small-size, light-weight image forming apparatus. The mono-component development system includes magnetic mono-component development and non-magnetic mono-component development.

In the magnetic mono-component development system, a magnetic material is contained in the toner, and a magnet is incorporated in the development roller. The magnetic toner is magnetically attracted and supplied to the development roller. In the non-magnetic mono-component development system, no magnetic material is contained in the toner, and the toner is supplied to the development roller by means of a toner supply member which is disposed in contact with the development roller.

A magnetic material contained in the magnetic toner assumes a black color or other colors with strong tinting power. Therefore, it is difficult that a magnetic material be employed for the color toner so as not to impair the original color tone of the color toner. In view of the above-mentioned drawback of the magnetic material, a non-magnetic color toner is widely used in the mono-component development system.

In the non-magnetic mono-component development system, however, the replenishment performance of the toner to the development roller, and the retaining performance of the toner on the development roller are unsatisfactory as it is. In practice, the toner is forcibly pressed against the development roller, or the amount of toner retaining on the development roller is regulated by means of a blade. As a result, there easily occurs the so-called filming phenomenon that a toner film sticks to the surface of the development roller. In addition, the life of the development roller is shortened, and the charge quantity of toner becomes unstable. Namely, stable development cannot be ensured.

As previously mentioned, the color toner for use with the non-magnetic mono-component development system is required to meet not only ordinary conditions for the toner, but also the additional conditions, for example, the prevention of toner filming.

To eliminate the shortcomings of the conventional color toner, a variety of color toners are proposed.

For instance, in Japanese Laid-Open Patent Application 5-53369, there is proposed a toner comprising (1) finely-divided inorganic particles which have a specific surface area in a range of 1 to 150 $m^2/g$ (in accordance with the BET adsorption isotherm), and are treated with a coupling agent having a saturated or unsaturated cyclic or non-cyclic organic group having 5 or more carbon atoms, and (2) finely-divided inorganic particles which have a specific surface area in a range of 160 to 400 $m^2/g$ (in accordance with the BET adsorption isotherm) and a hydrophobic degree of 30% or more.

When the above-mentioned toner is used for a two-component developer, the charge quantity of toner is susceptible to change. When the toner is used in the mono-component development system, the charging characteristics of toner on the development roller become unstable, so that the toner tends to fall off the development roller or scatter therefrom.

A toner disclosed in Japanese Laid-Open Patent Application 6-202374 is a non-magnetic mono-component toner which comprises matrix toner particles and finely-divided inorganic particles deposited on the matrix toner particles, with the inorganic particles having an average particle size of 30 nm or more and less than 100 nm. This toner has the shortcomings in fluidity and replenishment performance.

In Japanese Laid-Open Patent Application 8-15890, there is proposed a mono-component developer comprising matrix toner particles with an average particle size of 4 to 9 μm, and an external additive which includes small-size particles with an average particle size of 7 to 20 nm and large-size particles with an average particle size of 20 to 80 nm, with the small-size particles being contained in an amount of 1 to 2 wt %.

This toner has also the shortcomings that the toner tends to fall off the development roller and scatter therefrom because the charging characteristics of toner on the development roller are unstable.

Furthermore, a toner is disclosed in Japanese Laid-Open Patent Application 8-227171, which comprises matrix toner particles with an average particle size of 1 to 9 μm, and an external additive. The external additive comprises finely-divided inorganic particles with an average particle size of 10 to 90 nm which have been treated to be hydrophobic, and finely-divided particles of a silicone compound with an average particle size of 30 to 120 nm which have been hydrophobically treated.

The above-mentioned toner is unstable in charge quantity when used in a two-component developer. When the toner is used as the mono-component developer, the toner tends to fall off the development roller and scatter therefrom because of the unstable charging characteristics on the development roller.

In addition, a toner disclosed in Japanese Laid-Open Patent Application 9-288369 comprises silica particles having a specific surface area of 20 to 50 $m^2/g$ (in accordance with the BET adsorption isotherm), a pH value of 6 to 8, and a hydrophobic degree of 85% or more.

This toner has the drawbacks that the fluidity is insufficient and the replenishing performance is unsatisfactory.

There is disclosed a non-magnetic mono-component toner in Japanese Laid-Open Patent Application 9-297424. The above-mentioned toner comprises matrix toner particles, each comprising a polyester resin having a softening point (Sp) of 90 to 115° C., and having such a glass transition point (Tg) as satisfies the relationship of $(Sp)+110 \leqq 4(Tg) \leqq (Sp)+170$. Further, finely-divided particles with a specific surface area of 70 $m^2/g$ (in accordance with the BET adsorption isotherm) are deposited on the surfaces of the matrix toner particles. However, the fluidity of the above-mentioned toner is insufficient, and the replenishment performance tends to become poor.

A toner disclosed in Japanese Laid-Open Patent Application 10-3179 comprises matrix toner particles with an average particle size of 4 to 12 μm, and an externally added additive. The externally added additive comprises finely-divided inorganic particles with an average particle size of 1 to 50 nm, resin powders with an average particle size of 0.1 to 2 μm, and metallic oxide particles with an average particle size of 0.3 to 3 μm. The fluidity of this toner is still insufficient and the replenishment performance of the toner to the development roller is still unsatisfactory.

SUMMARY OF THE INVENTION

Accordingly, it is an object of the present invention to provide a color toner for use in the field of electrophotography, capable of exhibiting stable development performance for an extended period of time.

The above-mentioned object of the present invention can be achieved by a color toner for electrophotography comprising (i) matrix toner particles, each matrix toner particle comprising a binder resin, a coloring agent, and a charge control agent, and (ii) an externally added additive comprising (a) hydrophobically treated silica particles having a primary particle size of 0.01 to 0.03 μm, (b) hydrophobically treated titanium oxide particles having a primary particle size of 0.01 to 0.03 μm and a specific surface area of 60 to 140 $m^2/g$, and (c) hydrophobically treated silica particles having a specific surface area of 20 to 50 $m^2/g$ and a bulk density of 100 to 250 g/l.

It is preferable that the externally added additive comprise 0.2 to 1.0 part by weight of the hydrophobically treated silica particles (a), 0.2 to 0.8 parts by weight of the hydrophobically treated titanium oxide particles (b), and 0.5 to 2.0 parts by weight of the hydrophobically treated silica particles (c), to 100 parts by weight of the matrix toner particles.

Further, it is preferable that the externally added additive be deposited on the matrix toner particles by the steps of mixing the matrix toner particles, the hydrophobically treated silica particles (a) and the hydrophobically treated titanium oxide particles (b) to prepare a mixture, and adding the hydrophobically treated silica particles (c) to the mixture.

The charge control agent may comprises a metallic salt of a salicylic acid compound.

In addition, it is preferable that the matrix toner particles have a volume mean diameter of 4 to 10 μm.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein:

a single FIGURE is a schematic cross sectional view showing one embodiment of a development unit where the color toner according to the present invention is effectively used.

DESCRIPTION OF THE PREFERRED EMBODIMENTS

When used in the two-component developer system, a color toner is commonly required to be uniformly supplied to the surface of a carrier and deposited thereon so as to acquire a necessary charge quantity by stirring. In this case, the color toner is also required to show stable charge quantity and fluidity during a long-term operation even though the toner is consumed and a new toner is replenished in the developer.

On the other hand, when the color toner is used as a non-magnetic mono-component toner, the color toner is first required to be uniformly supplied to the development roller to form a uniform toner layer on the development roller. Further, the color toner on the development roller is required to be sufficiently charged, with a minimum change in the obtained charge quantity regardless of the long-term rotating operation of the development roller and the change of ambient conditions. Another requirement is to prevent the fused toner from sticking to the development roller and a toner thin film regulating member.

The inventors of the present invention have intensively studied and found that the color toner of the present invention can eliminate the shortcomings of the conventional color toners, and can meet the above-mentioned requirements. This is because the above-specified hydrophobic silica particles (a), hydrophobic titanium oxide particles (b), and hydrophobic silica particles (c) are used in combination as the externally added additive components together with the matrix toner particles in the color toner of the present invention.

Namely, the hydrophobically treated silica particles (a) have a primary particle size of 0.01 to 0.03 μm. It is preferable that the amount of the hydrophobic silica particles (a) be in the range of 0.2 to 1.0 part by weight, more preferably in the range of 0.4 to 0.8 parts by weight, with respect to 100 parts by weight of the matrix toner particles.

The hydrophobic silica particles (a) in the above specified amount can be deposited on the surfaces of the matrix toner particles to impart the fluidity and charge quantity to the toner. When the color toner comprising the above-mentioned hydrophobic silica particles (a) is used in a two-component developer, the toner can be efficiently supplied to the surface of the carrier, and at the same time, the toner can acquire a proper charge quantity. In a non-magnetic mono-component developer, the replenishment performance of the toner to the development roller is improved, and therefore, the development performance from the development roller to the photoconductor becomes better.

When the primary particle diameter of the hydrophobic silica particles (a) is less than 0.01 μm, these silica particles tend to be embedded in the matrix toner particles through a long-term stirring by the development roller. The result is that the fluidity of toner particles is lowered. When the primary particle diameter of the hydrophobic silica particles (a) exceeds 0.03 μm, the toner is not provided with sufficient fluidity.

When the amount of the silica particles (a) is less than 0.2 parts by weight, a sufficient amount of toner cannot be supplied to the development roller, and a charge quantity of toner necessary for development may not be obtained. In contrast to this, when the amount of the hydrophobic silica particles (a) exceeds 1.0 part by weight, the charge quantity of toner becomes too high to perform stable development, and the toner may scatter from the development unit.

The hydrophobically treated titanium oxide particles (b) have a primary particle size of 0.01 to 0.03 μm, and a specific surface area of 60 to 140 $m^2/g$.

It is preferable that the hydrophobic titanium oxide particles (b) be contained in an amount of 0.2 to 0.8 parts by weight, more preferably 0.3 to 0.6 parts by weight, to 100 parts by weight of the matrix toner particles The above-mentioned amount of hydrophobic titanium oxide particles (b) can stabilize the charging characteristics of toner, in particular, improve the charge rise-up characteristics and prevent the toner from being excessively charged.

When the primary particle diameter of the hydrophobic titanium oxide particles (b) is less than 0.01 μm, these titanium oxide particles tend to be embedded in the matrix toner particles through a long-term stirring by the development roller. The result is that the fluidity of toner particles is lowered. When the primary particle diameter of the hydrophobic titanium oxide particles (b) exceeds 0.03 μm, the toner may not be provided with sufficient fluidity.

When the amount of the titanium oxide particles (b) is less than 0.2 parts by weight, the charge quantity of toner becomes too high to perform stable development. In contrast to this, when the amount of the hydrophobic titanium oxide particles (b) exceeds 0.8 part by weight, the toner particles tend to scatter from the development unit and the toner deposition on the background may take place due to low charging characteristics of toner.

The hydrophobically treated silica particles (c) have a specific surface area of 20 to 50 $m^2/g$, preferably 25 to 45 $m^2/g$, and a bulk density of 100 to 250 g/l.

It is preferable that the amount of the hydrophobic silica particles (c) be in the range of 0.5 to 2.0 parts by weight with respect to 100 parts by weight of the matrix toner particles.

When the hydrophobic silica particles (c) in an amount of 0.5 to 2.0 parts by weight are deposited on the surfaces of the matrix toner particles in an amount of 100 parts by weight in the two-component development system, the charging characteristics and the fluidity of the toner are stable even after a long-term stirring operation with the carrier particles, thereby preventing the deterioration of the development performance and the transfer performance. In the mono-component development system, a toner thin film on the development roller can be made uniform, and unevenness in the thickness of the toner thin film can be drastically improved. Further, even after a long-term rotating operation of the development roller, the fused toner can be prevented from sticking to a developer coating blade. Therefore, non-printed streaks do not occur in a solid image portion.

When the specific surface area of the hydrophobic silica particles (c) is smaller than 20 $m^2/g$, those silica particles easily peel off from the surfaces of the matrix toner particles. In this case, the effect obtained by the addition of those hydrophobic silica particles (c) is likely to lessen.

In contrast to this, when the specific surface area of the hydrophobic silica particles (c) exceeds 50 $m^2/g$, the characteristics of the toner, such as the charging characteristics and the fluidity of the toner, are susceptible to change when the toner is used in a two-component developer. In the mono-component development system, the toner thin film becomes uneven.

The specific surface area of the titanium oxide particles (b) or the silica particles (c) is measured from the BET adsorption isotherm.

When the bulk density of the hydrophobic silica particles (c) is less than 100 g/l, the fluidity of toner may decrease. In contrast to this, when the bulk density exceeds 250 g/l, the characteristics of toner, such as the charging characteristics and the fluidity may vary during a long-term stirring operation together with the carrier particles in the case where the toner is used in the two-component developer. In the mono-component developer, a toner thin film formed on the development roller may become uneven.

When the amount of the hydrophobic silica particles (c) is less than 0.5 parts by weight, the characteristics of toner, such as the charging characteristics and the fluidity may vary during a long-term stirring operation together with the carrier particles in the case where the toner is used in the two-component developer. In the mono-component developer, a toner thin film formed on the development roller may become uneven, so that uniform development cannot be performed, and therefore, uniform toner images cannot be produced. Further, the fused toner unfavorably sticks to the surface of a developer coating blade, so that non-printed streaks may appear in a solid image portion.

In contrast to this, when the amount of the silica particles (c) exceeds 2.0 parts by weight, the amount of silica particles becomes excess, so that the excessive silica particles cannot be deposited on the surfaces of the matrix toner particles, thereby hindering the charging stability of toner.

As previously explained, the combination of the matrix toner particles and the above-mentioned three kinds of external additive components has not been proposed.

Silica particles prepared by wet method or dry method are usable as the materials for the above-mentioned hydrophobic silica particles (a) and (c) for use in the present invention. From the viewpoint of fluidity, preferable is the so-called humid silica, which is prepared by subjecting a silicon halide to vapor phase oxidation according to the conventional dry method. For instance, the humid silica is prepared by pyrolytic oxidation of silicon tetrachloride gas in oxyhydrogen flame. Such a reaction is indicated by the following formula:

$$SiCl_4+2H_2+O_2 \rightarrow SiO_2+4HCl$$

In the above-mentioned reaction, when a metallic halide such as aluminum chloride or titanium chloride is subjected to the reaction together with the above-mentioned silicon halide, it is possible to obtain composite particles comprising silica and metallic oxide. The thus obtained composite silica particles may also be employed in the present invention.

Subsequently, the finely-divided silica particles are treated to be hydrophobic. To make the silica particles hydrophobic, the finely-divided silica particles may be surface-treated with a silane compound. Namely, the hydroxyl group of the silica particles is allowed to react with a silane compound to substitute siloxyl group for the hydroxyl group.

To be more specific, the silica particles are allowed to react with a silane compound, such as dialkylsilane dihalide, trialkylsilane halide, hexaalkyl disilazane or alkylsilane trihalide at high temperatures.

The hydrophobic degree referred to in the present invention is a ratio of the amount of hydroxyl group disappearing through the above-mentioned reaction of the surface treatment to the total amount of hydroxyl group present in the silica particles before the surface treatment.

The hydrophobic degree is measured by the following method:

50 ml of water is placed in a 200-ml beaker, and 0.2 g of silica particles is put into water. With gently stirring the water with a magnetic stirrer, methanol is added to water using a burette of which the tip portion is dipped in water.

The volume (ml) of methanol added to water is read when the silica particles which are originally floating on water has completely sunk in water. Then, the hydrophobic degree of the silica particles is obtained in accordance with the following formula:

$$\text{Hydrophobic degree} = \frac{\text{Volume (ml) of methanol added to water}}{(50 + \text{methanol (ml) added to water})} \times 100\ (\%)$$

With the addition of methanol, the silica particles that are originally floating on water are gradually dispersed in water. This is because methanol serves as a surfactant. The larger the hydrophobic degree in the above-mentioned formula, the higher the ratio of the amount of hydroxyl group lost in the reaction to that of hydroxyl group present before the reaction.

The titanium oxide particles (b) for use in the present invention are prepared by the sulfuric acid method or the chlorine method. In the present invention, there can be employed the titanium oxide in the form of rutile-type crystalline, anatase-type crystalline, amorphous, and mixed type.

The surface treatment to make the titanium oxide particles (b) hydrophobic can be carried out in a similar manner as in the case of the silica particles (a) and (c) as mentioned above.

To coat the above-mentioned external additive components on the matrix toner particles, the external additive components and the matrix toner particles may be mechanically mixed using a variety of mixers.

In particular, it is preferable that the matrix toner particles be first mixed with the hydrophobic silica particles (a) and the hydrophobic titanium oxide particles (b) to prepare a mixture, and thereafter the mixture be blended with the hydrophobic silica particles (c). Through the above-mentioned mixing procedures, the external additive components can be effectively prevented from peeling off from the matrix toner particles. As a result, the external additive components do not transfer from the surface of the matrix toner particles to the surface of the carrier particles, so that the charge imparting effect of the carrier is not impaired in the two-component development system. In the mono-component development system, it is possible to reduce the unevenness of the toner thin film on the development roller that is supposed to occur because of the presence of the external additive components between the development roller and the developer coating blade.

According to the above-mentioned mixing method including the two steps, there is no risk of the external additive components aggregating. Therefore, these external additive components can be uniformly deposited on the matrix toner particles. For such a reason, the above-mentioned two-step mixing method is preferably employed in the present invention.

The color toner according to the present invention comprises matrix toner particles, each matrix toner particle comprising a charge control agent. It is preferable that the charge control agent for use in the present invention comprise a metallic salt of a salicylic acid derivative. By use of such a charge control agent, the toner can acquire a stable charge quantity as being stirred with the carrier when the color toner is used in the two-component developer. In the case of the mono-component development system, stable charging characteristics can be ensured.

The above-mentioned metallic salt of salicylic acid derivative for use in the present invention is represented by the following formula (I):

(I)

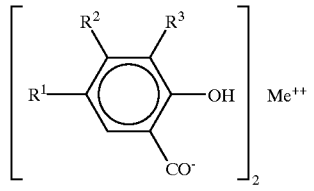

wherein $R^1$, $R^2$ and $R^3$ are each a hydrogen atom, an alkyl group having 1 to 10 carbon atoms, or an allyl group, and $R^1$, $R^2$ and $R^3$ may be the same or different; and Me represents a metal selected from the group consisting of zinc, nickel, cobalt, copper and chromium.

In the above formula (I), it is preferable that $R^1$, $R^2$ and $R^3$ be each a hydrogen atom, an alkyl group having 1 to 6 carbon atoms, or an allyl group.

The aforementioned metallic salt of salicylic acid derivative can be easily synthesized by the method described in CLARK, J, L, Kao, H(1948) J. Amer. Chem. Soc. 70,2151. For instance, 2 moles of sodium salicylate (or a sodium salt of a salicylic acid derivative) and 1 mole of zinc chloride are added to a solvent and mixed. The thus obtained mixture is heated with stirring, thereby obtaining a zinc salt of a salicylic acid.

The resultant metallic salt of salicylic acid precipitates as white crystals. Therefore, the metallic salt has no effect on the color of a toner when dispersed in the binder resin. Other metallic salts than the zinc salt can be prepared in accordance with the above-mentioned method.

In the color toner of the present invention, it is preferable that the amount of a metallic salt of a salicylic acid derivative be in the range of about 0.1 to 10 parts by weight, more preferably about 0.5 to 5 parts by weight, with respect to 100 parts by weight of the binder resin.

Specific examples of the metallic salt of salicylic acid derivative are shown in the following TABLE 1.

TABLE 1

Compound No. 1

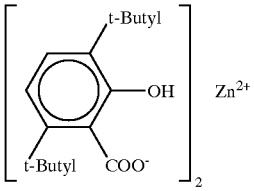

No. 2

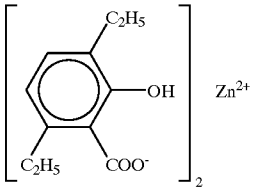

No. 3

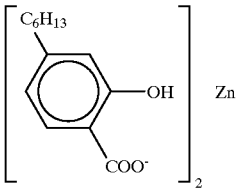

No. 4

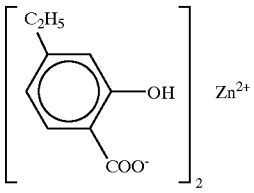

No. 5

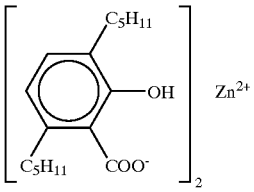

No. 6

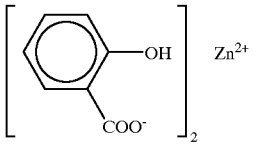

No. 7

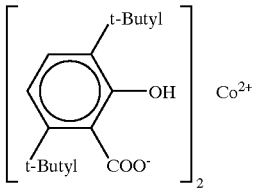

No. 8

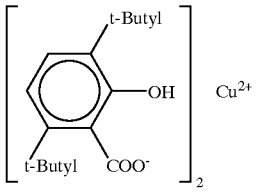

No. 9

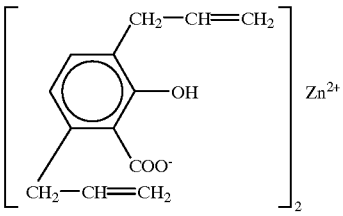

It is preferable that the color toner of the present invention comprise matrix toner particles with a volume mean diameter of 4 to 10 $\mu$m.

A smaller volume mean diameter than the above-mentioned lower limit may cause the problem that the fused toner particles adhere to the surfaces of the carrier particles during the long-term stirring operation, so that the toner cannot be provided with sufficient charge quantity when the toner is used in the two-component developer. In the mono-component development system, the amount of toner on the development roller may become insufficient, and the fused toner particles tend to stick to the development roller and the developer coating blade during the long-term rotating operation of the development roller.

In contrast to this, a greater volume mean diameter than the above-mentioned upper limit may cause the problem that a sufficient charge quantity cannot be imparted to the toner particles. In the mono-component development system, the toner thin film on the development roller may become uneven, and the amount of toner on the development roller is susceptible to change during the long-term rotating operation.

The toner of the present invention comprises a binder resin. A variety of binder resins are usable, but a polyester resin and a polyol resin are particularly preferable when the fixing properties, gloss, transparency, and charging stability required for the color toner are taken into consideration.

With respect to the polyester resin, various kinds of polyester resins are usable. A polyester resin prepared by condensation polymerization of a diol component represented by the following formula (II) and a polyfunctional carboxylic acid component selected from the group consisting of a polyfunctional carboxylic acid having two or more carboxyl groups, and anhydrides and lower alkyl esters of the polyfunctional carboxylic acid is preferable in the present invention.

(II)

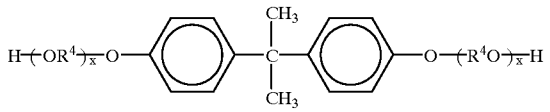

wherein $R^4$ is an alkylene group having 2 to 4 carbon atoms; and x and y are each a positive integer, provided that the total sum of x and y is 2 to 16 on the average.

As the polyfunctional carboxylic acid, there can be employed phthalic acid, isophthalic acid, terephthalic acid, maleic acid, fumaric acid, anhydrides and lower alkyl esters of the above-mentioned acids, trimellitic acid and anhydrides thereof, and succinic acid derivatives such as n-dodecenylsuccinic acid, n-dodecylsuccinic acid, n-butylsuccinic acid, iso-dodecenylsuccinic acid, and iso-octylsuccinic acid.

In particular, when any of the above-mentioned succinic acid derivatives is introduced, there can be obtained a color toner capable of exhibiting excellent image fixing performance at low temperatures and improved gloss.

Specific examples of the diol component represented by formula (II) are polyoxypropylene(2.2)-2,2-bis(4-hydroxyphenyl)propane, polyoxyester(2)-2,2-bis(4-hydroxyphenyl)propane, polyoxypropylene(6)-2,2-bis(4-hydroxyphenyl)propane, and polyoxypropylene(16)-2,2-bis(4-hydroxyphenyl)propane.

The above-mentioned diol component may comprise a polyhydroxy compound having two or more functional groups in an amount of about 5 mol. % or less.

Examples of such a polyhydroxy compound are ethylene glycol, propylene glycol, glycerin, pentaerythritol, trimethylolpropane, hydrogenated bisphenol A, sorbitol, and etherified products of the above-mentioned polyhydroxyl compounds.

In general, the polyester resin can be prepared by subjecting a polyol component and a polyfunctional carboxylic acid component to condensation polymerization in an inert atmosphere at 180 to 250° C.

In the present invention, it is preferable to employ a polyol resin which is prepared by allowing the following components to react: (1) an epoxy resin; (2) an alkylene oxide adduct of a dihydric phenol, or a glycidyl ether thereof; (3) a compound having in the molecule thereof one active hydrogen atom which is capable of reacting with epoxy group; and (4) a compound having in the molecule thereof two or more active hydrogen atoms which are capable of reacting with epoxy group.

Further, as the above-mentioned epoxy resin (1), it is preferable to employ at least two kinds of bisphenol A type epoxy resin components with different number-average molecular weights.

By use of such a polyol resin, there can be obtained a color toner provided with excellent gloss, transparency and anti-offset performance.

With respect to the epoxy resin (1), it is preferable to employ an epoxy resin synthesized by allowing a bisphenol such as bisphenol A or bisphenol F to react with epichlorohydrin.

The alkylene oxide adduct of dihydric phenol (2) used in the preparation of the polyol resin is a reaction product between ethylene oxide, propylene oxide, butylene oxide or a mixture thereof, and a bisphenol such as bisphenol A or bisphenol F.

The thus obtained alkylene oxide adduct may be prepared into a glycidyl ether using epichlorohydrin or β-methylepichlorohydrin. In particular, a diglycidyl ether of an alkylene oxide adduct of bisphenol A, represented by the following formula (III), is preferable in the present invention:

(III)

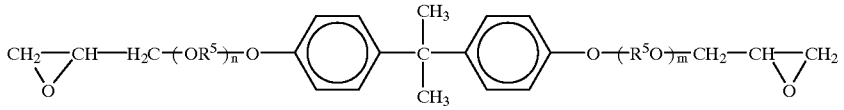

wherein $R^5$ represents $—CH_2—CH_2—$, $—CH_2—CH(CH_3)—$, or $—CH_2—CH_2—CH_2—$; and n and m are each an integer of 1 or more, provided that the sum of n and m is in the range of 2 to 6.

It is preferable that the alkylene oxide adduct of dihydric phenol or a glycidyl ether thereof be in an amount of 10 to 40 wt % of the total weight of the obtained polyol resin. When the amount of the alkylene oxide adduct or a glycidyl ether thereof is less than the above-mentioned amount, there may cause a problem of a toner-image-bearing material being curled. Further, when the total sum of n and m is 7 or more in the above-mentioned formula (III), or when the amount of the alkylene oxide adduct or a glycidyl ether thereof is more than the above-mentioned amount, the gloss of the color toner becomes excessive or the preservation stability of the color toner tends to be impaired.

Examples of the aforementioned compound (3) having in the molecule thereof one active hydrogen atom that is capable of reacting with epoxy group are monohydric phenols, secondary amines, and carboxylic acids.

Specific examples of the monohydric phenols are phenol, cresol, isopropylphenol, aminophenol, nonylphenol, dodecylphenol, xylenol, and p-cumylphenol.

Specific examples of the secondary amines are diethylamine, dipropylamine, dibutylamine, N-methyl piperazine, N-ethyl piperazine, and piperidine.

Specific examples of the carboxylic acids are propionic acid and caproic acid.

Examples of the aforementioned compound (4) having in the molecule thereof two or more active hydrogen atoms that are capable of reacting with epoxy group are dihydric phenols, polyhydric phenols, and polyfunctional carboxylic acids.

Specific examples of the above-mentioned dihydric phenols are bisphenols such as bisphenol A and bisphenol F.

Specific examples of the polyhydric phenols are o-cresol novolac, phenol novolac, tris(4-hydroxyphenyl)methane, and 1-[α-methyl-α-(4-hydroxyphenyl)ethyl]benzene.

Specific examples of the polyfunctional carboxylic acids are malonic acid, succinic acid, glutaric acid, adipic acid, maleic acid, fumaric acid, phthalic acid, terephthalic acid, trimellitic acid, and trimellitic anhydride.

In order to obtain a polyol resin having an epoxy resin moiety and an alkylene oxide moiety in the main chain thereof, the combination of various starting materials is possible.

For instance, a polyol resin can be obtained by allowing an epoxy resin having two glycidyl terminal groups and an alkylene oxide adduct of a dihydric phenol having two glycidyl terminal groups to react with dihalide, diisocyanate, diamine, dithiol, polyhydric phenol, or dicarboxylic acid.

In the above, it is most preferable that the above epoxy resin and alkylene oxide adduct be allowed to react with a dihydric phenol in light of the reaction stability.

It is also preferable that a polyhydric phenol and a polyfunctional carboxylic acid be used in combination with the dihydric phenol as long as no gelation takes place.

When a polyhydric phenol and a polyfunctional carboxylic acid are employed in combination with a dihydric phenol, the amount of the polyhydric phenol and the polyfunctional carboxylic acid is 15 wt % or less, preferably 10 wt. % or less, of the entire weight of the mixture.

It is preferable that the above-mentioned polyester resin or polyol resin be not crosslinked or slightly crosslinked to such a degree that the amount of an insoluble component thereof is 5% or less when dissolved in THF. This is because when the crosslinking density of the resin is high, it is difficult to obtain appropriate transparency and gloss in the color toner image.

To obtain proper gloss, transparency, and image fixing properties in the color toner image, it is preferable that the binder resin for use in the toner have a ½ flow initiation temperature in a range of 110 to 130° C. The ½ flow initiation temperature is measured by the following method.

By use of a capillary rheometer (Trademark "Flowtester CFT-500" made by Shimadzu Corporation), 1 $cm^3$ of a binder resin sample is caused to fuse and flow under the conditions that capillary dies with a diameter of 1 mm were used, the applied pressure was set at 20 $kg/cm^2$, and the temperature elevation rate was set at 6° C./min. The temperature corresponding to one half of the height from the flow initiation temperature to the flow termination temperature is determined as the ½ flow initiation temperature of the sample binder resin.

As the coloring agent for use in the color toner of the present invention, there can be employed any dyes and pigments that are capable of achieving yellow, magenta, cyan and black color toners.

Specific examples of the conventional dyes and pigments are Carbon Black, Lamp Black, Ultramarine, Aniline Blue, Phthalocyanine Blue, Phthalocyanine Green, Hansa Yellow G, Rhodamine 6G Lake, Chalco Oil Blue, Chrome Yellow, Quinacridone, Benzidine Yellow, Rose Bengale, and Triarylmethane.

Those conventional dyes and pigments can be employed alone or in combination.

It is preferable that the amount of the coloring agent be in the range of 1 to 20 wt %, more preferably in the range of 3 to 20 wt %, of the total weight of the binder resin.

The toner of the present invention may further comprise a wax when necessary in order to improve the image fixing properties.

Specific examples of the waxes include micro wax, candelilla wax, carnauba wax, rice wax, montan wax, paraffin wax, polyethylene wax, and polypropylene wax.

With respect to the charge control agent for use in the color toner of the present invention, a metallic salt of salicylic acid derivative is preferable as mentioned above. In addition, the toner may be provided with stable charging characteristics by the addition of a transparent or white charge control agent that is not likely to impair the color tone of the toner. As such a charge control agent, there can be employed an organic boron salt, a fluorine-containing quaternary ammonium salt, and a calixarene compound.

As the external additive, alumina may also be used as the fluidity imparting agent in addition to the above-mentioned hydrophobic silica particles (a) and (c) and hydrophobic titanium oxide particles (b). When necessary, metallic salts of fatty acids and polyvinylidene fluoride may be added to the color toner of the present invention.

To prepare a two-component developer, the toner of the present invention is used in combination with the carrier. In the present invention, there can be employed as the carrier particles inorganic powders, metallic powders with a proper resistivity, and resin powders in which particles with a relatively low resistivity are dispersed. Further, such carrier particles may further comprise a surface layer which is provided on the core carrier particles. The structure of the carrier particles may be selected so that the predetermined charge quantity can be imparted to toner particles by triboelectric charging.

As the inorganic powders, glass beads are usable. For the metallic powders, any conventional metals such as iron, cobalt, and nickel; and metallic compounds such as magnetite and ferrite can be employed.

For the resin powders and/or the surface layer provided on the core particles, the following resins can be used: polyolefin resins such as polyethylene, polypropylene, chlorinated polyethylene and chlorosulfonated polyethylene; polyvinyl resins and polyvinylidene resins such as polystyrene, acrylic resin (eg. polymethyl methacrylate), polyacrylonitrile, polyvinyl acetate, polyvinyl alcohol, polyvinyl butyral, polyvinyl chloride, polyvinyl carbazole, polyvinyl ether and polyvinyl ketone; vinyl chloride-vinyl acetate copolymer; silicone resin having organosiloxane bond and modified products thereof (for exmaple, modified with alkyd resin, polyester resin, epoxy resin, or polyurethane); fluoroplastics such as polytetrafluoroethylene, polyvinyl fluoride, polyvinylidene fluoride, and polychlorotrifluoroethylene; polyamide; polyester; polyurethane; polycarbonate; amino resin such as urea-formaldehyde resin; and epoxy resin.

In particular, for the preparation of the surface layer with which the core particles are coated, silicone resins and modified products thereof, and fluoroplastics are preferably employed because the so-called toner spent phenomenon can be effectively prevented. For this purpose, the silicone resins and modified products thereof are most preferable. Any conventional silicone resins, for instance, a straight silicone resin consisting of organosiloxane bond, and an alkyd-, polyester-, epoxy-, or urethane-modified silicone resin are known.

In order to control the volume resistivity of the carrier particles, a material with a low resistivity may be dispersed in the resin powders or the surface layer provided on the core particles. Any conventional materials with a low resistivity, for example, metals such as iron, gold, and copper, iron oxide such as ferrite and magnetite, and pigments such as carbon black may be dispersed in the resin powders or the surface layer. In particular, a mixture of furnace black and acetylene black, each belonging to the carbon black, is preferably employed in the resin powders or the surface layer. This is because a small amount of the mixture of furnace black and acetylene black can effectively control the electroconductivity of the carrier particles. Further, the wear resistance of the carrier particles can be improved when the mixture of furnace black and acetylene black is dispersed in the resin powders or the surface layer.

It is preferable that such a low-resistivity material have a particle diameter of about 0.01 to 10 μm. Further, it is preferable that the low-resistivity material be contained in an amount of 2 to 30 parts by weight, more preferably 5 to 20 parts by weight, to 100 parts by weight of the resin constituting the powders or the surface layer.

For the purpose of improving the adhesion of the surface layer to the core particle, and increasing the dispersibility of the low-resistivity material in the resin powders or in the surface layer, a silane coupling agent or a titanium coupling agent may be added to the resin powders or the surface layer.

The surface layer can be provided on the core particles of the carrier particles in the conventional manner, for example, by coating a surface layer formation liquid on the core particles by spray coating or dip coating method. It is proper that the thickness of the surface layer provided on the core particle be 0.1 to 2 μm.

The color toner of the present invention can be used in the conventional two-component development unit or mono-component development unit.

The two-component development unit is provided with such a mechanism that can stir toner particles together with carrier particles. The two-component developer thus obtained by stirring operation is supplied to a rotating magnet-incorporated development roller by means of a doctor blade, with the supplied amount of developer being controlled. The developer on the development roller is magnetically attracted to the photoconductor when the developer reaches a position adjacent to the photoconductor. This development method is generally employed, but the two-development system is not limited thereto.

A variety of development methods are applicable to the mono-component development system. The color toner of the present invention is adaptable to those mono-component development systems. In particular, a beneficial effect can be obtained when the color toner of the present invention is used in a mono-component development unit equipped with a development roller comprising a metallic material, and a developer coating blade or roller of which the surface portion is made of a rubber material. The developer coating blade or roller comes in contact with the development roller to form a toner thin film on the development roller.

Namely, by use of the development roller comprising a metallic material, the toner thin film on the development roller can be efficiently made uniform, and accordingly, the unevenness of the toner thin film can be drastically improved. Further, the amount of toner retained on the development roller becomes stable even after a long-term rotating operation of the development roller.

Other features of this invention will become apparent in the course of the following description of exemplary embodiments, which are given for illustration of the invention and are not intended to be limiting thereof.

EXAMPLE 1

The following binder resin, charge control agent and coloring agent designated for each color toner were thoroughly mixed in a blender, fused and kneaded in a two-roll mill heated to 100–110° C., and then cooled to room temperature, whereby a kneaded lump was obtained.

The thus obtained lump was coarsely crushed in a cutter mill, and finely pulverized in a pulverizer using air jet stream. Then, the pulverized mixture was classified by an air classification apparatus, whereby matrix toner particles for each color toner were obtained.

| | Parts by Weight |
|---|---|
| Binder resin 1: (polyester resin with a 1/2 flow initiation temp. of 119° C.) | 50 |
| Binder resin 2: (polyol resin with a 1/2 flow initiation temp. of 115° C.) | 50 |
| Charge control agent: (fluorine-containing quaternary ammonium salt compound) | 3 |
| Coloring agent: | |
| (For yellow toner) Bisazo yellow pigment (C.I. Pigment Yellow 17) | 5 |
| (For magenta toner) Naphthol magenta pigment (C.I. Pigment Red 184) | 4 |
| (For cyan toner) Copper phthalocyanine blue pigment (C.I. Pigment Blue 15) | 2 |
| (For black toner) Carbon black | 5 |

The volume mean diameter of the matrix toner particles for each color was as follows:

Yellow matrix toner particles: 8.3 μm

Magenta matrix toner particles: 8.1 μm

Cyan matrix toner particles: 8.4 μm

Black matrix toner particles: 8.5 μm

The volume mean diameter was measured using a commercially available measuring apparatus "Coulter Counter TA-II" (Trademark), made by Coulter Electronics Ltd.

To 100 parts by weight of the matrix toner particles for each color toner, 0.5 parts by weight of the following external additive component (b) were first added, and thereafter 0.5 parts by weight of the following external additive component (a) and 1.5 parts by weight of the following external additive component (c) were added and blended. The resultant mixture was stirred in a Henschel mixer, so that a yellow toner, a magenta toner, a cyan toner, and a black toner according to the present invention were obtained.

External additive component (a): Hydrophobic silica particles (surface-treated with hexamethyldisilazane)

Hydrophobic degree: 80%

Primary particle size: 0.02 μm

External additive component (b): Hydrophobic titanium oxide particles (surface-treated with isobutyltrimethoxysilane)

Hydrophobic degree: 70%

Specific surface area: 100 $m^2/g$

Primary particle size: 0.02 μm

External additive component (c): Hydrophobic silica particles (surface-treated with hexamethyldisilazane)

Hydrophobic degree: 90%

Specific surface area: 40 $m^2/g$

Bulk density: 120 g/l

The thus obtained color toners were set in a commercially available copying machine "My Ricopy M-5" (Trademark), made by Ricoh Company, Ltd., which was partially modified.

The non-magnetic mono-component development unit of the modified copying machine is shown in a single FIGURE. As illustrated in the FIGURE, a development roller 2 comprises a core 2-1 and a resin-coated layer 2-2 provided on the core 2-1, comprising a silicone resin. A toner supply member 3 is disposed in contact with the development roller 2, and a surface portion of the toner supply member 3 which comes in contact with the development roller 2 is made of a polyurethane material. A blade 4 comprising an urethane material is disposed in contact with the development roller 2.

A development roller prepared by providing the resin-coated layer 2-2 (silicone resin) on the core 2-1 was employed in Example 1. In Examples 2 to 5 and Comparative Examples 1 to 3, a development roller consisting of a metallic material was employed.

Reference numeral 1 indicates a latent image bearing member, that is, a photoconductor belt; reference numeral 5, an agitator; a reference numeral 6, a development zone; and reference numeral 7, a color toner.

Evaluation of Toner (1) Charge quantity of toner and toner deposition amount on development roller The charge quantity of toner prepared in the form of a thin film layer on the development roller was measured by the following method.

The toner particles formed on the development roller were sucked into a Faraday cage equipped with a filter disposed at the outlet side using a vacuum pump. From the entire weight and the total electric charge quantity of the toner particles trapped in the Faraday cage, the charge quantity ($\mu$C/g) of toner was calculated.

At the same time, the toner deposition amount per unit area on the development roller was calculated from the weight of the toner particles trapped in the Faraday cage and the surface area of the development roller subjected to sucking.

The optimal ranges of the charge quantity and the toner deposition amount on the development roller are shown below, which vary depending upon various factors, such as the ratio of the linear speed of the development roller to that of the photoconductor.

Charge quantity: 10 to 25 $\mu$C/g (or −10 to −25 $\mu$C/g)

Toner deposition amount: 0.4 to 1.2 (mg/cm$^2$)

To stabilize the amount of toner supplied to the development zone, it is preferable that the above-mentioned characteristic values be constant even though the development roller is driven in rotation for a long period of time for producing numerous copies.

(2) Formation of a toner thin film on the development roller

It was visually observed whether a uniform thin film of toner was formed on the development roller or not.

Further, the development unit was decomposed after a long-term rotating operation of the development roller. After removal of the toner particles from the development unit, it was visually checked whether the toner in the form of a film tightly adhered to the surface of the development roller or not, and whether the toner stuck to the surface of the developer coating blade.

The evaluation results were that the toner thin film on the development roller was uniform even after making of 30,000 copies. The change in both the charge quantity and the toner deposition amount on the development roller was very slight after making of 30,000 copies. The detailed results are shown in TABLE 2.

EXAMPLE 2

The following binder resin, charge control agent and coloring agent designated for each color toner were thoroughly mixed in a blender, fused and kneaded in a two-roll mill heated to 100–110° C., and then cooled to room temperature, whereby a kneaded lump was obtained.

The thus obtained lump was coarsely crushed in a cutter mill, and finely pulverized in a pulverizer using air jet stream. Then, the pulverized mixture was classified by an air classification apparatus, whereby matrix toner particles for each color toner were obtained.

| | Parts by Weight |
|---|---|
| Binder resin: (polyester resin with a 1/2 flow initiation temp. of 121° C.) | 100 |
| Charge control agent: (fluorine-containing quaternary ammonium salt compound) | 3 |
| Coloring agent: | |
| (For yellow toner) Bisazo yellow pigment (C.I. Pigment Yellow 17) | 5 |
| (For magenta toner) Naphthol magenta pigment (C.I. Pigment Red 134) | 4 |
| (For cyan toner) Copper phthalocyanine blue pigment (C.I. Pigment Blue 15) | 2 |
| (For black toner) Carbon black | 5 |

The volume mean diameter of the matrix toner particles for each color was as follows:

Yellow matrix toner particles: 7.4 $\mu$m

Magenta matrix toner particles: 7.3 $\mu$m

Cyan matrix toner particles: 7.2 $\mu$m

Black matrix toner particles: 7.3 $\mu$m

The volume mean diameter was measured in the same manner as in Example 1.

To 100 parts by weight of the matrix toner particles for each color toner, 0.7 parts by weight of the following external additive component (a) and 0.8 parts by weight of the following external additive component (b) were first added, and thereafter 2.0 parts by weight of the following external additive component (c) were added and blended. The resultant mixture was stirred in a Henschel mixer, so that a yellow toner, a magenta toner, a cyan toner, and a black toner according to the present invention were obtained.

External additive component (a): Hydrophobic silica particles (surface-treated with polydimethylsiloxane)

Hydrophobic degree: 70%

Primary particle size: 0.015 $\mu$m

External additive component (b): Hydrophobic titanium oxide particles (surface-treated with methyltrimethoxysilane)

Hydrophobic degree: 80%

Specific surface area: 70 m$^2$/g

Primary particle size: 0.015 $\mu$m

External additive component (c): Hydrophobic silica particles (surface-treated with dimethyldichlorosilane)

Hydrophobic degree: 90%

Specific surface area: 35 m$^2$/g

Bulk density: 150 g/l

Then, the evaluations of the color toners obtained in Example 2 were carried out in the same manner as in Example 1. The evaluation results were that the toner thin film on the development roller was uniform even after making of 30,000 copies. The detailed results are shown in TABLE 2.

EXAMPLE 3

The following binder resin, charge control agent and coloring agent designated for each color toner were thoroughly mixed in a blender, fused and kneaded in a two-roll mill heated to 100–110° C., and then cooled to room temperature, whereby a kneaded lump was obtained.

The thus obtained lump was coarsely crushed in a cutter mill, and finely pulverized in a pulverizer using air jet stream. Then, the pulverized mixture was classified by an air classification apparatus, whereby matrix toner particles for each color toner were obtained.

| | Parts by Weight |
|---|---|
| Binder resin: (polyester resin with a 1/2 flow initiation temp. of 120° C.) | 100 |
| Charge control agent: (metallic salt of salicyclic acid derivative No. 4 in TABLE 1) | 3 |
| Coloring agent: | |
| (For yellow toner) Bisazo yellow pigment (C.I. Pigment Yellow 17) | 5 |
| (For magenta toner) Naphthol magenta pigment (C.I. Pigment Red 184) | 4 |
| (For cyan toner) Copper phthalocyanine blue pigment (C.I. Pigment Blue 15) | 2 |
| (For black toner) Carbon black | 5 |

The volume mean diameter of the matrix toner particles for each color was as follows:

Yellow matrix toner particles: 8.6 μm

Magenta matrix toner particles: 8.4 μm

Cyan matrix toner particles: 8.8 μm

Black matrix toner particles: 8.7 μm

The volume mean diameter was measured in the same manner as in Example 1.

To 100 parts by weight of the matrix toner particles for each color toner, 1.0 part by weight of the following external additive component (a) and 0.7 parts by weight of the following external additive component (b) were first added, and thereafter 1.0 part by weight of the following external additive component (c) were added and blended. The resultant mixture was stirred in a Henschel mixer, so that a yellow toner, a magenta toner, a cyan toner, and a black toner according to the present invention were obtained.

External additive component (a): Hydrophobic silica particles (surface-treated with dimethyldichlorosilane)

Hydrophobic degree: 70%

Primary particle size: 0.02 μm

External additive component (b): Hydrophobic titanium oxide particles (surface-treated with tetradecyltrichlorosilane)

Hydrophobic degree: 60%

Specific surface area: 120 $m^2/g$

Primary particle size: 0.03 μm

External additive component (c): Hydrophobic silica particles (surface-treated with hexamethyldisilazane)

Hydrophobic degree: 80%

Specific surface area: 25 $m^2/g$

Bulk density: 220 g/l

Then, the evaluations of the color toners obtained in Example 3 were carried out in the same manner as in Example 1. The evaluation results were that the toner thin film on the development roller was uniform even after making of 30,000 copies. The detailed results are shown in TABLE 2.

EXAMPLE 4

The following binder resin, charge control agent and coloring agent designated for each color toner were thoroughly mixed in a blender, fused and kneaded in a two-roll mill heated to 100–110° C., and then cooled to room temperature, whereby a kneaded lump was obtained.

The thus obtained lump was coarsely crushed in a cutter mill, and finely pulverized in a pulverizer using air jet stream. Then, the pulverized mixture was classified by an air classification apparatus, whereby matrix toner particles for each color toner were obtained.

| | Parts by Weight |
|---|---|
| Binder resin: (polyol resin with a 1/2 flow initiation temp. of 115° C.) | 100 |
| Charge control agent: (metallic salt of salicyclic acid derivative No. 1 in TABLE 1) | 4 |
| Coloring agent: | |
| (For yellow toner) Bisazo yellow pigment (C.I. Pigment Yellow 17) | 5 |
| (For magenta toner) Naphthol magenta pigment (C.I. Pigment Red 184) | 4 |
| (For cyan toner) Copper phthalocyanine blue pigment (C.I. Pigment Blue 15) | 2 |
| (For black toner) Carbon black | 5 |

The volume mean diameter of the matrix toner particles for each color was as follows:

Yellow matrix toner particles: 8.0 μm

Magenta matrix toner particles: 7.7 μm

Cyan matrix toner particles: 7.8 μm

Black matrix toner particles: 7.9 μm

The volume mean diameter was measured in the same manner as in Example 1.

To 100 parts by weight of the matrix toner particles for each color toner, 0.6 parts by weight of the following external additive component (a) and 0.3 parts by weight of the following external additive component (b) were first added, and thereafter 1.2 parts by weight of the following external additive component (c) were added and blended. The resultant mixture was stirred in a Henschel mixer, so that a yellow toner, a magenta toner, a cyan toner, and a black toner according to the present invention were obtained.

External additive component (a): Hydrophobic silica particles (surface-treated with hexamethyldisilazane)

Hydrophobic degree: 80%

Primary particle size: 0.02 μm

External additive component (b): Hydrophobic titanium oxide particles (surface-treated with isobutyltrimethoxysilane)

Hydrophobic degree: 50%

Specific surface area: 120 $m^2/g$

Primary particle size: 0.02 μm

External additive component (c): Hydrophobic silica particles (surface-treated with hexamethyldisilazane)

Hydrophobic degree: 80%

Specific surface area: 45 $m^2/g$

Bulk density: 170 g/l

Then, the evaluations of the color toners obtained in Example 4 were carried out in the same manner as in Example 1. The evaluation results were that the toner thin film on the development roller was uniform even after making of 30,000 copies. The detailed results are shown in TABLE 2.

EXAMPLE 5

The following binder resin, charge control agent and coloring agent designated for each color toner were thoroughly mixed in a blender, fused and kneaded in a two-roll mill heated to 100–110° C., and then cooled to room temperature, whereby a kneaded lump was obtained.

The thus obtained lump was coarsely crushed in a cutter mill, and finely pulverized in a pulverizer using air jet stream. Then, the pulverized mixture was classified by an air classification apparatus, whereby matrix toner particles for each color toner were obtained.

| | Parts by Weight |
|---|---|
| Binder resin: (polyester resin with a 1/2 flow initiation temp. of 122° C.) | 100 |
| Charge control agent: (metallic salt of salicyclic acid derivative No. 5 in TABLE 1) | 3.5 |
| Coloring agent: | |
| (For yellow toner) Bisazo yellow pigment (C.I. Pigment Yellow 17) | 5 |
| (For magenta toner) Naphthol magenta pigment (C.I. Pigment Red 184) | 4 |
| (For cyan toner) Copper phthalocyanine blue pigment (C.I. Pigment Blue 15) | 2 |
| (For black toner) Carbon black | 5 |

The volume mean diameter of the matrix toner particles for each color was as follows:

Yellow matrix toner particles: 4.5 μm

Magenta matrix toner particles: 4.8 μm

Cyan matrix toner particles: 5.0 μm

Black matrix toner particles: 4.7 μm

The volume mean diameter was measured in the same manner as in Example 1.

To 100 parts by weight of the matrix toner particles for each color toner, 0.7 parts by weight of the following external additive component (a) and 0.4 parts by weight of the following external additive component (b) were first added, and thereafter 0.7 parts by weight of the following external additive component (c) were added and blended. The resultant mixture was stirred in a Henschel mixer, so that a yellow toner, a magenta toner, a cyan toner, and a black toner according to the present invention were obtained.

External additive component (a): Hydrophobic silica particles (surface-treated with polydimethylsiloxane)

Hydrophobic degree: 70%

Primary particle size: 0.03 μm

External additive component (b): Hydrophobic titanium oxide particles (surface-treated with isobutyltrimethoxysilane)

Hydrophobic degree: 60%

Specific surface area: 130 $m^2/g$

Primary particle size: 0.02 μm

External additive component (c): Hydrophobic silica particles (surface-treated with polydimethylsiloxane)

Hydrophobic degree: 70%

Specific surface area: 40 $m^2/g$

Bulk density: 170 g/l

Then, the evaluations of the color toners obtained in Example 5 were carried out in the same manner as in Example 1. The evaluation results were that the toner thin film on the development roller was uniform even after making of 30,000 copies. The detailed results are shown in TABLE 2.

Comparative Example 1

The following binder resin, charge control agent and coloring agent designated for each color toner were thoroughly mixed in a blender, fused and kneaded in a two-roll mill heated to 100–110° C., and then cooled to room temperature, whereby a kneaded lump was obtained.

The thus obtained lump was coarsely crushed in a cutter mill, and finely pulverized in a pulverizer using air jet stream. Then, the pulverized mixture was classified by an air classification apparatus, whereby matrix toner particles for each color toner were obtained.

| | Parts by Weight |
|---|---|
| Binder resin: (polyester resin with a 1/2 flow initiation temp. of 120° C.) | 100 |
| Charge control agent: (fluorine-containing quaternary ammonium salt compound) | 3 |
| Coloring agent: | |
| (For yellow toner) Bisazo yellow pigment (C.I. Pigment Yellow 17) | 5 |
| (For magenta toner) Naphthol magenta pigment (C.I. Pigment Red 184) | 4 |
| (For cyan toner) Copper phthalocyanine blue pigment (C.I. Pigment Blue 15) | 2 |
| (For black toner) Carbon black | 5 |

The volume mean diameter of the matrix toner particles for each color was as follows:

Yellow matrix toner particles: 7.7 μm

Magenta matrix toner particles: 7.4 μm

Cyan matrix toner particles: 7.6 μm

Black matrix toner particles: 7.8 μm

The volume mean diameter was measured in the same manner as in Example 1.

To 100 parts by weight of the matrix toner particles for each color toner, 0.9 parts by weight of the following external additive component (a) and 1.0 part by weight of the following external additive component (b) were added and blended. The resultant mixture was stirred in a Henschel mixer, so that a comparative yellow toner, a comparative magenta toner, a comparative cyan toner, and a comparative black toner were obtained.

External additive component (a): Hydrophobic silica particles (surface-treated with polydimethylsiloxane)

Hydrophobic degree: 50%

Primary particle size: 0.02 μm

External additive component (b): Hydrophobic titanium oxide particles (surface-treated with isobutyltrimethoxysilane)

Hydrophobic degree: 70%

Specific surface area: 100 $m^2/g$

Primary particle size: 0.02 μm

Then, the evaluations of the color toners obtained in Comparative Example 1 were carried out in the same manner as in Example 1. The results were that the toner filming phenomenon was observed on the development roller and the toner stuck to the surface of the developer coating blade after making of 30,000 copies. The charge quantity and the toner deposition amount on the development roller decreased, and the toner thin film on the development roller became uneven after making of 30,000 copies. The detailed results are shown in TABLE 2.

Comparative Example 2

The following binder resin, charge control agent and coloring agent designated for each color toner were thoroughly mixed in a blender, fused and kneaded in a two-roll mill heated to 100–110° C., and then cooled to room temperature, whereby a kneaded lump was obtained.

The thus obtained lump was coarsely crushed in a cutter mill, and finely pulverized in a pulverizer using air jet stream. Then, the pulverized mixture was classified by an air classification apparatus, whereby matrix toner particles for each color toner were obtained.

| | Parts by Weight |
|---|---|
| Binder resin: (polyol resin with a 1/2 flow initiation temp. of 120° C.) | 100 |
| Charge control agent: (metallic salt of salicylic acid derivative No. 2 in TABLE 1) | 3.5 |
| Coloring agent: | |
| (For yellow toner) Bisazo yellow pigment (C.I. Pigment Yellow 17) | 5 |
| (For magenta toner) Naphthol magenta pigment (C.I. Pigment Red 184) | 4 |
| (For cyan toner) Copper phthalocyanine blue pigment (C.I. Pigment Blue 15) | 2 |

-continued

| | Parts by Weight |
|---|---|
| (For black toner) Carbon black | 5 |

The volume mean diameter of the matrix toner particles for each color was as follows:

Yellow matrix toner particles: 7.1 μm

Magenta matrix toner particles: 7.2 μm

Cyan matrix toner particles: 7.0 μm

Black matrix toner particles: 6.8 μm

The volume mean diameter was measured in the same manner as in Example 1.

To 100 parts by weight of the matrix toner particles for each color toner, 0.7 parts by weight of the following external additive component (a) and 0.7 parts by weight of the following external additive component (c) were added and blended. The resultant mixture was stirred in a Henschel mixer, so that a comparative yellow toner, a comparative magenta toner, a comparative cyan toner, and a comparative black toner were obtained.

External additive component (a): Hydrophobic silica particles (surface-treated with hexamethyldisilazane)

Hydrophobic degree: 50%

Primary particle size: 0.02 μm

External additive component (c): Hydrophobic silica particles (surface-treated with hexamethyldisilazane)

Hydrophobic degree: 90%

Specific surface area: 40 $m^2/g$

Bulk density: 150 g/l

Then, the evaluations of the color toners obtained in Comparative Example 2 were carried out in the same manner as in Example 1. The results were that the charge quantity decreased, the toner thin film on the development roller became uneven, and the toner particles fell off the development roller after making of 30,000 copies. The detailed results are shown in TABLE 2.

Comparative Example 3

The following binder resin, charge control agent and coloring agent designated for each color toner were thoroughly mixed in a blender, fused and kneaded in a two-roll mill heated to 100–110° C., and then cooled to room temperature, whereby a kneaded lump was obtained.

The thus obtained lump was coarsely crushed in a cutter mill, and finely pulverized in a pulverizer using air jet stream. Then, the pulverized mixture was classified by an air classification apparatus, whereby matrix toner particles for each color toner were obtained.

| | Parts by Weight |
|---|---|
| Binder resin: (polyester resin with a 1/2 flow initiation temp. of 119° C.) | 100 |
| Charge control agent: (fluorine-containing quaternary ammonium salt compound) | 3.5 |
| Coloring agent: | |
| (For yellow toner) | 5 |

-continued

| | Parts by Weight |
|---|---|
| Bisazo yellow pigment (C.I. Pigment Yellow 17) (For magenta toner) | 4 |
| Naphthol magenta pigment (C.I. Pigment Red 184) (For cyan toner) | 2 |
| Copper phthalocyanine blue pigment (C.I. Pigment Blue 15) (For black toner) | 5 |
| Carbon black | |

The volume mean diameter of the matrix toner particles for each color was as follows:

Yellow matrix toner particles: 8.6 μm

Magenta matrix toner particles: 8.4 μm

Cyan matrix toner particles: 8.5 μm

Black matrix toner particles: 8.5 μm

The volume mean diameter was measured in the same manner as in Example 1.

To 100 parts by weight of the matrix toner particles for each color toner, 0.7 parts by weight of the following external additive component (b) and 0.6 parts by weight of the following external additive component (c) were added and blended. The resultant mixture was stirred in a Henschel mixer, so that a comparative yellow toner, a comparative magenta toner, a comparative cyan toner, and a comparative black toner were obtained.

External additive component (b): Hydrophobic titanium oxide particles (surface-treated with isobutyltrimethoxysilane)

Hydrophobic degree: 70%

Specific surface area: 130 $m^2/g$

Primary particle size: 0.02 μm

External additive component (c): Hydrophobic silica particles (surface-treated with hexamethyldisilazane)

Hydrophobic degree: 50%

Specific surface area: 40 $m^2/g$

Bulk density: 150 g/l

Then, the evaluations of the color toners obtained in Comparative Example 3 were carried out in the same manner as in Example 1. The results were that the charge quantity of toner was low at the initial stage, and the toner particles fell off the development roller. The detailed results are shown in TABLE 2.

TABLE 2

| | Characteristics of Toner on Development Roller | | | | |
|---|---|---|---|---|---|
| | At initial stage | | After making of 30,000 copies | | |
| | Charge quantity (−μC/g) | Toner deposition amount ($mg/cm^2$) | Charge quantity (−μC/g) | Toner deposition amount ($mg/cm^2$) | Material of Development Roller |
| Examples | | | | | |
| 1 | 14 | 0.72 | 13 | 0.64 | Silicone-resin coated roller |

TABLE 2-continued

| | Characteristics of Toner on Development Roller | | | | |
|---|---|---|---|---|---|
| | At initial stage | | After making of 30,000 copies | | |
| | Charge quantity (−μC/g) | Toner deposition amount ($mg/cm^2$) | Charge quantity (−μC/g) | Toner deposition amount ($mg/cm^2$) | Material of Development Roller |
| 2 | 14 | 0.60 | 12 | 0.65 | Aluminum roller |
| 3 | 15 | 0.58 | 19 | 0.60 | Aluminum roller |
| 4 | 20 | 0.76 | 19 | 0.74 | SUS roller |
| 5 | 19 | 0.54 | 18 | 0.53 | Aluminum roller |
| Comparative Examples | | | | | |
| 1 | 14 | 0.70 | 8 | 0.21 | Aluminum roller |
| 2 | 22 | 0.59 | 6 | 0.56 | SUS roller |
| 3 | 7 | 0.75 | 6 | 0.73 | Aluminum roller |

EXAMPLE 6

A two-component developer was prepared using the color toner prepared in Example 1. To be more specific, 5 parts by weight of each of the color toners prepared in Example 1 were mixed with 95 parts by weight of the carrier shown below for 10 minutes using a blender.

Carrier

Core particles: spherical ferrite particles with an average particle size of 50 μm.

Surface layer provided on core particles: a silicone resin in which an aminosilane coupling agent was dispersed.

The aminosilane coupling agent and the silicone resin were dispersed in toluene to prepare a dispersion. The thus prepared dispersion was spray-coated on the core particles under heating conditions. The resin-coated ferrite particles were subjected to sintering, and thereafter cooled, so that carrier particles having a surface resin layer with an average thickness of 0.2 μm were obtained.

The charge quantity of toner was measured by the blow-off method using an electrometer. As a result, the initial charge quantity was −24 μC/g.

The two-component developer thus obtained was set in a commercially available copying machine "PRETER 650" (Trademark), made by Ricoh Company, Ltd., and toner images were produced. The produced images were excellent.

After making of 30,000 copies, the charge quantity of toner was −21 μC/g, and the image quality was still excellent.

EXAMPLE 7

5 parts by weight of each color toner prepared in Example 4 were mixed with 95 parts by weight of the same carrier as employed in Example 6 for 10 minutes, using a blender. Thus, a two-component developer was obtained.

The initial charge quantity was −28 μC/g.

The image evaluation was carried out in the same manner as in Example 6. The result was that excellent toner images were produced.

After making of 30,000 copies, the charge quantity of toner was −25 μC/g, and the image quality was still excellent.

EXAMPLE 8

5 parts by weight of each color toner prepared in Example 5 were mixed with 95 parts by weight of the same carrier as employed in Example 6 for 10 minutes, using a blender. Thus, a two-component developer was obtained.

The initial charge quantity was −27 μC/g.

The image evaluation was carried out in the same manner as in Example 6. The result was that excellent toner images were produced.

After making of 30,000 copies, the charge quantity of toner was −26 μC/g, and the image quality was still excellent.

Comparative Example 4

5 parts by weight of each color toner prepared in Comparative Example 1 were mixed with 95 parts by weight of the same carrier as employed in Example 6 for 10 minutes, using a blender. Thus, a two-component developer was obtained.

The initial charge quantity was −29 μC/g.

The image evaluation was carried out in the same manner as in Example 6. The result was that excellent toner images were produced at the initial stage, but the charge quantity of toner decreased to −15 μC/g after making of 30,000 copies. In addition, toner deposition on the background appeared, and non-transferred spots were observed in the toner image due to defective image transfer after making of 30,000 copies.

The evaluation results in Examples 6 to 8 and Comparative Example 4 are shown in TABLE 3.

TABLE 3

| | At Initial Stage | | After Making of 30,000 Copies | |
|---|---|---|---|---|
| | Charge quantity (−μC/g) | Toner concentration (wt/%) | Charge quantity (−μC/g) | Toner concentration (wt/%) |
| Examples | | | | |
| 6 | 24 | 5.0 | 21 | 5.3 |
| 7 | 28 | 5.0 | 25 | 5.2 |
| 8 | 27 | 5.0 | 26 | 4.9 |
| Comp. Ex. | | | | |
| 4 | 29 | 5.0 | 15 | 4.0 |

As previously explained, the color toner of the present invention comprises matrix toner particles, each comprising a binder resin, a coloring agent, and a charge control agent, and the three kinds of external additive components. Therefore, the characteristics of the toner in the development unit are stable for an extended period of time, so that excellent development performance is exhibited.

When the external additive components (a) and (b) are mixed with the matrix toner particles in advance, and the external additive component (c) was added thereto, the characteristics of the toner can be kept in a good condition more effectively.

When the charge control agent for use in the toner comprises a metallic salt of salicylic acid derivative, the charging characteristics of the toner can be further stabilized for a long period of time.

By specifying the volume mean diameter of the matrix toner particles, more stable development performance can be ensured.

Japanese Patent Applications No. 10-322190 filed Nov. 12, 1998 and 11-8896 filed Jan. 8, 1999 are hereby incorporated by reference.

What is claimed is:

1. A color toner for electrophotography comprising (i) matrix toner particles, each matrix toner particle comprising a binder resin, a coloring agent, and a charge control agent, and (ii) an externally added additive comprising:

(a) hydrophobically treated silica particles having a primary particle size of 0.01 to 0.03 μm, (b) hydrophobically treated titanium oxide particles having a primary particle size of 0.01 to 0.03 μm and a specific surface area of 60 to 140 $m^2/g$, and (c) hydrophobically treated silica particles having a specific surface area of 20 to 50 $m^2/g$ and a bulk density of 100 to 250 g/l.

2. The color toner as claimed in claim 1, wherein said externally added additive comprises 0.2 to 1.0 part by weight of said hydrophobically treated silica particles (a), 0.2 to 0.8 parts by weight of said hydrophobically treated titanium oxide particles (b), and 0.5 to 2.0 parts by weight of said hydrophobically treated silica particles (c), to 100 parts by weight of said matrix toner particles.

3. The color toner as claimed in claim 1, wherein said externally added additive is deposited on said matrix toner particles by the steps of:

mixing said matrix toner particles, said hydrophobically treated silica particles (a) and said hydrophobically treated titanium oxide particles (b) to prepare a mixture, and adding said hydrophobically treated silica particles (c) to said mixture.

4. The color toner as claimed in claim 1, wherein said charge control agent comprises a metallic salt of a salicylic acid compound.

5. The color toner as claimed in claim 1, wherein said matrix toner particles have a volume mean diameter of 4 to 10 μm.

* * * * *

UNITED STATES PATENT AND TRADEMARK OFFICE

CERTIFICATE OF CORRECTION

PATENT NO. : 6,103,441
DATED : August 15, 2000
INVENTOR(S) : Masami Tomita et al.

It is certified that error appears in the above-identified patent and that said Letters Patent is hereby corrected as shown below:

Column 18,
Line 23, "Red 134" should read -- Red 184 --.

Signed and Sealed this

Second Day of April, 2002

*Attest:*

*Attesting Officer*

JAMES E. ROGAN
*Director of the United States Patent and Trademark Office*